United States Patent [19]

Grätz et al.

[11] 4,425,745

[45] Jan. 17, 1984

[54] OUTER WALL SUSPENDED IN FRONT OF A METAL STRUCTURE

[75] Inventors: Johannes Grätz, Düsseldorf; Ferdinand Kerstges, Essen, both of Fed. Rep. of Germany

[73] Assignee: Steag Aktiengesellschaft, Essen, Fed. Rep. of Germany

[21] Appl. No.: 269,824

[22] Filed: Jun. 2, 1981

[30] Foreign Application Priority Data

Jun. 4, 1980 [DE] Fed. Rep. of Germany ..... 3021198

[51] Int. Cl.[3] ..... E04H 1/00

[52] U.S. Cl. ..... 52/235; 52/508; 52/512

[58] Field of Search ..... 52/508, 512, 506, 235

[56] References Cited

U.S. PATENT DOCUMENTS 2,174,988 10/1939 Lundrall ..... 52/508 X 3,523,395 8/1970 Rutter et al. ..... 52/508 X 3,982,372 9/1976 Haeussler ..... 52/235 X 4,238,987 12/1980 Siebrecht-Reuter ..... 52/508 X

*Primary Examiner*—Carl D. Friedman

*Attorney, Agent, or Firm*—Michael J. Striker

[57] ABSTRACT

An outer wall has plate-like sound damping elements with a rear vented facade liner as a weather protection, a plurality of thread bolts connected with cross bars and extending through the sound damping elements so that a portion of each of the thread bolts extends in a gap between the sound damping elements and the rear vented facade liner, a plurality of further thread bolts extending into the rear vented facade liner, a thread bushing composed of corrosion resistant material and screwed at least over that portion of each of the thread bolts to cover that portion, and a nut screwed at an outer side of the rear vented facade liner on an end portion of each of the further thread bolts.

18 Claims, 3 Drawing Figures

OUTER WALL SUSPENDED IN FRONT OF A METAL STRUCTURE

BACKGROUND OF THE INVENTION

The invention relates to an outer wall with plate-like sound dampening elements which are suspended on a metal structure with cross bars made of structural steel.

Such cross bar structures for supporting an outer wall constructed by dampening elements having a rear vented facade liner are particularly used in the construction of power plants for cost and weight saving reasons. Thereby, a sound emission diagram is first defined which shows the sound stress in the various frequencies caused by the machines, devices and installations in the enclosed space. Since a defined sound emission cannot be exceeded on the property borders, it is necessary to provide a defined sound dampening in the corresponding frequencies, due to the sound stress. This sound dampening is obtained by dampening elements which are mounted on the outer side of the cross bars and which in a free suspension bridge the intermediary space between the cross bars and consist, for example, of mineral fiber dampening material elements with an edge side metal flashing which are covered on both sides by asbestos cement or asbestos silicon plates. The cover plates may have different thicknesses and form a particularly effective sound dampening element together with the hollow space dampening from the mineral fiber dampening material plate, depending on the coordination in the desired frequencies. The sound dampening effect substantially depends from the density of the sound dampening elements, so that the same are comparably heavy. The facade lining, for example, made of aluminum trapeze sheet metal, asbestos cement corrugated plates, or the like, serve as a weather protection for the free side of the sound dampening elements.

Weld bolts are used for mounting the sound dampening elements and the facade liner on the cross bars. Weld bolts made of structural steel with a sufficient hardness are used to assure a safe weld connection which can support the weight of the heat dampening elements which are mounted on the thread weld bolt and the weight of the facade liner; for example, the cross bars and the weld bolts may consist of steel St 37 in accordance with the German Industrial Standard DIN 17 100, wherein the weld bolts are provided with a specific material design at the end to be welded, in a known manner, so as to affect the welding process during the passing of current. The setting of the weld bolts must be carried out with great precision, whereby a sink hole is provided at the location where the given weld bolt is engaged, for a local removal of the rust protection paint of the cross bar and for exposing the blank metal for engaging the given weld bolt, whereby the end of the weld bolt is inserted into the sink bore and welded therewith by means of a welding machine. After welding, a rust protection painting is performed in the welding area and the thread welding bolt.

After setting of the thread weld bolts in the aforementioned manner, the sound dampening elements are mounted on the rows of weld bolts in the known outer wall and are pushed thereupon by means of nuts which are screwed onto the thread weld bolt ends with intermediary mounted distance clamping profiles. Thereby, the thread ends of the thread weld bolts protrude by such a length beyond the clamping nuts, thus enabling the facade lining to be fastened by a support nut on its outside, after being installed.

From the assembly point of view, it is disadvantageous that the clamping nut for fixing the sound dampening element must be screwed through the total long segment of the thread welding bolts which extends beyond the sound dampening element, thus requiring a substantial additional amount of time in view of the large number of thread weld bolts of a facade or ceiling wall. The rust protection paint of the "cold" area outside of the sound dampening elements, which also result in a certain heat dampening, the thread bolt is already exposed to damages over a long thread segment by screwing on the clamping nut, so that corrosion can occur, if the paint is not immediately replaced, which again requires a considerable amount of time. Despite of such an after repair, the rust protection paint remains in danger due to mechanical effects, thus it does not offer a real longtime rust protection. However, one has to work with such a subsequent rust protection by painting, or the like, since only structural steel can be used for the thread weld bolt and not precious steel, so as to enable a clean welding with the cross bars which are also made of structural steel. A use of precious steel for the cross bars, which would enable one to also use precious steel for the thread weld bolts and which would remove all corrosion problems, is out of the question because of economical cost saving reasons.

SUMMARY OF THE INVENTION

In contrast thereto, it is an object of the invention to provide an outer wall structure which enables the use of non-rusting materials in the corrosion endangered area outside of the sound dampening elements, thus enabling to provide a non-rusting mounting of the construction elements of the wall despite the use of commonly used structural steel for the cross bars and the thread weld bolts.

This object of the invention is attained by provision of a corrosion resistant threaded bushing on each thread bolt so that the threaded bushing covers its part located in a gap between the sound damping elements and the rear vented facade liner.

Due to the screwing of a thread bushing of corrosion resistant steel at the thread of the weld bolt, at least as far as the same protrudes freely from the outside of the sound dampening elements, it is covered by a non-rusting part in the corrosion endangered cold area of the wall for the segment of the weld bolt made of structural steel, and is thereby protected from corrosion. For the segment of the thread weld bolt which is located between the cross bars and the thread bushing it suffices to provide a rust protection paint, since this segment is located in the "warm" area of the wall wherein no corrosion occurs and wherein no screwing on of an outer thread occurs, after the rust protection paint has been applied, so that the paint is not exposed to any damages. Later damages are not possible, because this area will be covered by the sound dampening elements and are thus protected from mechanical damages. In contrast to the aforementioned known outer wall, the thread weld bolt is correspondingly shorter, so that it ends in each case within the thread bushing, even with unfavorable tolerances. Therafter, a thread bolt made of corrosion resistant steel may be screwed into the other end of the thread bushing which is disposed in the corrosion endangered area of the wall, but is not exposed to any corrosion due to its material. This thread bolt extends through the facade liner and supports at its outer end the supporting nut, which supports the facade liner against the outer end of the thread bushing, thus simultaneously serving as a distance piece for the facade liner. The distance between the facade liner and the outer face of the sound dampening elements is of critical importance for the sound dampening, since only by corresponding tests, in each individual case, the distance of the facade liner has to be determined, so as to prevent that the same are exited into vibrations by the sound. The thread bushings can be made in any desired length which would provide the desired length for each individual case, so that this distance is automatically obtained during assembly, without requiring any additional measures.

Therefore, the inventive structure is provided with only non-rusting connection means in the condensation endangered area outside of the sound dampening elements, since for all further elements, like the mounting nuts for the facade liner, gaskets, etc., aluminum, corrosion resistant steel or plastic may be used, depending on suitability, so that the structure corresponds to the "Guidelines for Facade Liners", in accordance with DIN 18 516, number 3.2.3 and 3.2.4. In the practice, this results in the substantial advantage that the filing of a construction supervision permit can be eliminated by pointing out that all requirements of the pertinent DIN-guidelines are met, so that no time and cost consuming of corresponding test certificates from official test institutions for each individual case are required.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
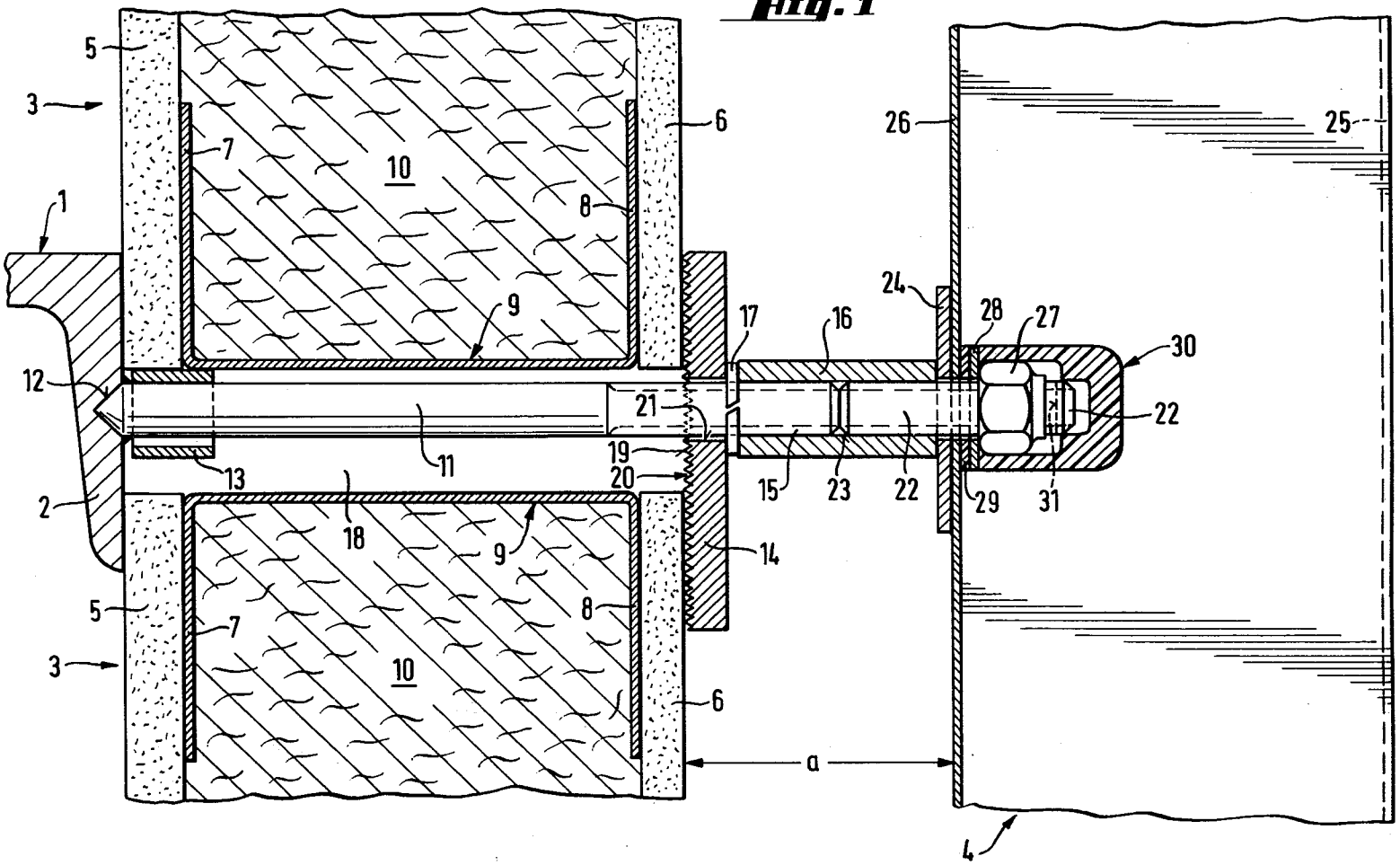
FIG. 1 a vertical partial segment through an inventive outer wall.

FIG. 1 shows a cross bar 1 made of structural steel which is a U-shaped profile, on the suspended outer shank 2 of which the inventive outer wall is to be mounted. The outer wall substantially consists of plate like sound dampening elements 3 which are disposed in one plane and a rear vented facade liner 4.

The sound dampening elements 3 are provided with cover plates 5 and 6 on both sides, for example, asbestos cement or asbestos silicon, which are commercially available. The cover plates 5 and 6 are mounted on lateral shanks 7 and 8 of a surrounding flashing 9 of a mineral fiber dampening material plate 10 and cover the same. Depending on the thickness and type of the mineral-fiber material for the dampening material plate 10, as well as the cover plates 5 and 6, which may have different thicknesses, a sound dampening is obtained for a sound admittance in different frequencies, whereby the total dampening capacity is essentially depending from the density and thereby the weight of the material, so that the sound dampening elements 3 construct comparably heavy.

The sound dampening elements are mounted on thread weld bolts 11 with their lower edges, whereby the thread welding bolts may consist of galvanized structural steel, as well as the cross bars 1 which may consist of steel ST 37 in accordance with DIN 17 100, that is, a non-alloyed steel or a light alloyed steel. In a known manner, the thread weld bolts 11 may be welded into previously provided sink bores 12 with their ends on the outer face of shank 2 of cross bars 1, whereby the thread weld bolt 11 serve themselves as the weld electrodes and have a particular material composition in the area adjacent to the welding location. Adjacent to the welding location, a sleeve 13 is pushed over the thread weld bolt 11 made of aluminum, for example, which serves as support for the inner area of the sound dampening elements 3, so that they are moment favorable supported with a low lever arm for the weld connection.

After placing the sound dampening elements 3 onto a row of welded thread weld bolts 11, clamping plates 14 made of aluminum or a suitable aluminum alloy like, AlMgSi 0,5 F 22 are pushed over the outer thread segment 15 of the thread weld bolt 11 and after srewing on a thread bushing 16 made of corrosion resistant steel over a spring ring 17 which is also made of corrosion resistant steel and pushed against the adjacent edges of the sound dampening elements 3 or the outer cover plates 6. Thereby, the sound dampening elements 3 are safely secured against cross bars 1.

Instead of individual clamping plates 14 with, for example, a rectangular shape, a remaining slot 18 which may be provided between one row of the thread bolts 11, as far a is required for the sound dampening, may be covered by a continuous clamping plate which extends over a plurality of laterally adjacent thread weld bolts 11, whereby a plurality of such clamping plates form a continuous horizontal band. As far as clamping plates 14 are only used in the area of the individual thread weld bolts 11, they are provided with ridges 20 or another suitable design, in particular on the inside 19 which prevent a twisting of the clamping plates 14 during dynamic swelling stresses due to wind admittance, etc., so that a twisting movement of the clamping plate cannot result in a detaching of the screw tension of the thread bushing 16. Furthermore, the throughput opening 21 in the clamping plate 14 for the shaft of the thread weld bolt 11 is mounted outside of the center of gravity of the clamping plate 14, in case of a rectangular shape in the shown manner slightly upwardly offset, so that clamping plate 14 which is pushed over the thread weld bolt 11 aligns automatically in a desired position due to gravity effects, so that all clamping plates 14 obtain the same alignment on the front of the sound dampening elements 3, without any additional measures. This does not only result in an aesthetic look when the facade liner is 4 is removed, but also assures that the desired clamping forces in all plates 14 are applied in the desired manner onto the dampening elements 3 or onto the edges thereof.

A further thread bolt 22 is screwed into the inner thread 23 of thread bushing 16 from the outside in such a manner that the thread weld bolt 11 and the thread bolt 22 with their adjacent thread ends within thread bushing 16 are engaging with each other under pressure. The thread bolt 22 does not necessarily have to have the same thread type as the thread segment 15 of the thread weld bolt 11, but it may be chosen smaller or larger, as desired, however, the simplest structure is obtained when the inner thread 23 of the thread bushing 16 is continous and the thread segment 15 and the thread of the thread bolt 22 are evenly designed. However, the thread bolt 22 does not consist of structural steel, but of a corrosion resistant steel, which is also true for the thread bushing 16.

Onto the thread bolt 22 which is screwed into the thread bushing 16, a gasket 24 of non rusting material, like precious steel, aluminum alloy or plastic material is mounted and the facade liner 4 is mounted thereon which is penetrated by the thread bolt 22 in corresponding openings. In the exemplified case, the facade liner 4 is designed as a trapeze plate, wherein the outer ribs are shown at 25 and the mounting ribs at 26. At the rear side of the mounting rib 26 which is penetrated by the thread bolt 22, a self securing support nut 27 is mounted on the thread bolt 22 consisting of corrosion resistant steel and presses against the outer side of the mounting rib 26 by means of a gasket 28 also consisting of corrosion resistant steel, as well as a gasket 29 made of plastic material, for example, neoprene, thus retaining the facade liner 4. Thereby, thread bushing 16 serves as a support with its outer shoulder, so that the thread bushing 16 serves as a distance piece for securing the distance a between the outer face of the sound dampening element 4 which is critical due to sound technological reasons. The support nut 27 may be covered by a plastic material cover 30.

The thread bolt 22 can be provided with a slot 31 at its outer disposed ends, so as to further screw it to the engagement to the end of the thread weld bolt 11 into thread bushing 16 independent from support nut 27, when the thread bushing is brought into its clamping position by means of pressure admittance of spring ring 17. This assures that in each case a maximum thread length is received by the thread bushing 16 and that the weight of the facade liner 4 is savely received. The disposition of the thread bushing 16 in front of the outer side of the sound dampening elements and thereby the reduced length of the thread bolt 22 result in a low lever arm for supporting the weight of the facade liner 4 on the segment of the thread bolt 22 which is screwed into the thread bushing 16. Therefore, the shown disposition of the thread bushing 16 is recommended in cases wherein a correspondingly large distance a should be maintained. However, if the distance a in an individual case has to be chosen so small that the thread bushing 16 for the two sided screwing of the thread weld bolt 11, on the one hand, and the thread bolt 22, on the other hand, would be too short, the required length of the thread bushing 16 could then be provided in the cover area of the sound dampening elements 3, whereby the pressing of the clamping plates 14 can be accomplished over circumferential shoulders in a center area of the clamping bushing 16, for example. In each case it is assured by the disposition of the thread bushing 16 that it fully covers the free protruding end which contains the thread segment 15 of thread weld bolt 11, if not already a cover occurs by the spring ring 17 made of corrosion resistant steel, by the clamping plate 14 made of aluminum or the sound dampening elements 3, thus obtaining a corrosion protection by such a cover. Therefore, in the "cold" condensation endangered area on the outside of the cover plates 6 only surfaces of non-rusting material are accessible so that an optimum corrosion protection is assured.

Figure 2:
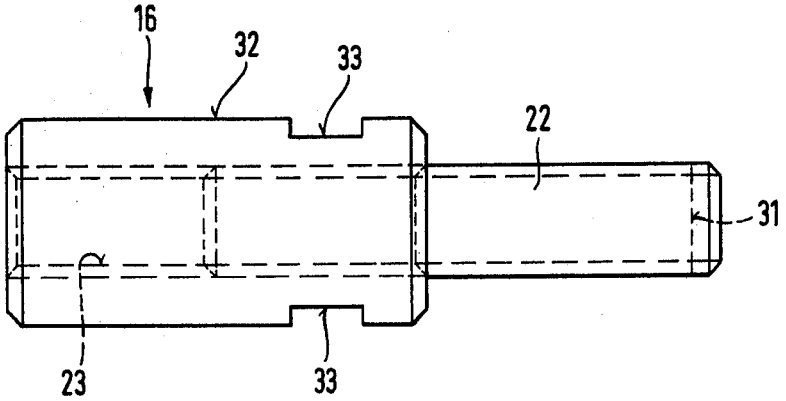
FIG. 2 an individual view of the thread bushing with thread bolt from FIG. 1 in a side view, and FIG. 3 a view of a modified embodiment of the thread bushing, corresponding to FIG. 2.

FIG. 2 shows the thread bushing 16 with screwed in thread bolt 22 as a detail. As can be seen therefrom, the thread bushing 16 can be premade having a cylindrical surface, that is, pipe-like, whereby suitable engagement faces 33 in form of oppositely disposed flat milled portions are provided at its outer circumference 32 which correspond to the opening of a suitable socket wrench, so that the same can engage thereon and that the thread bushing 16 can be turned with a common socket wrench, so as to affect the clamping effect through the spring ring 17 onto the clamping plate 14. Thereby, the manufacturer may already screw the thread bolt 22 somewhat into the thread bushing 16, so that this screw path can be saved during the assembly at the construction site, and after obtaining the desired clamping effect on the clamping plate 14, only a few subsequent turns have to be made with a screw driver on slot 31, so as to close the existing slot between the adjacent ends of the thread bolts in the thread bushing 16. Such a slot is required, in order to prevent an engagement of the bolt ends before obtaining the desired clamping effect on clamping plate 14.

Figure 3:
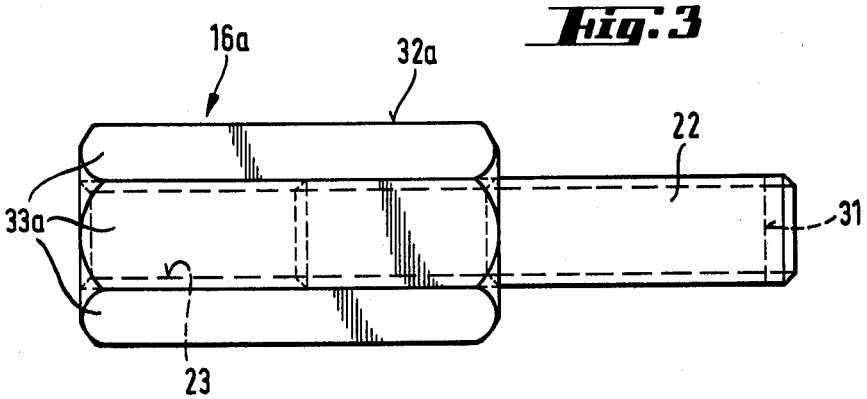

In the alternative embodiment in accordance with FIG. 3, the thread bushing **16*a* is designed as a commercially available longitudinal nut with an outer circumference 32*a* in form of a hexagonal with engagement faces 33*a*, so that any type of wrench of correct size can be used for clamping the thread bushing 16*a***.

As can be seen from the aforementioned description, the invention is not limited to the shown embodiments. Instead of the shown dampening elements 3 other dampening elements with different design may be chosen, as long as the required stressability for absorbing the wind stresses in the free suspending clamping of the dampening elements between vertically adjacent cross bars 1 is assured. The outer wall, is not only suitable as a side wall but also as a ceiling wall, whereby corresponding cross bars 1 can be provided in form of roof beams.

It will be understood that each of the elements described above, or two or more together, may also find a useful application in other types of constructions differing from the types described above.

While the invention has been illustrated and described as embodied in an outer wall suspended in front of a metal structure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An outer wall, comprising plate-like sound damping elements with a rear vented facade liner as a weather protection; and means for suspending said sound damping elements with said rear vented facade liner, said suspending means including a plurality of cross bars, a plurality of thread bolts connected with said cross bars and extending through said sound damping elements so that a portion of each of said thread bolts extends in a gap between said sound damping elements and said rear vented facade liner, a plurality of further thread bolts arranged into said rear vented facade liner and also having a portion extending in the gap between said sound damping elements and said rear vented facade liner, a thread bushing composed of corrosion resistant material and screwed at least over said portion of each of said first mentioned thread bolts and over said portion of each of said further thread bolts to cover the same, and a nut screwed at an outer side of said rear vented facade liner on an end portion of each of said further thread bolts.

2. An outer wall as defined in claim 1, wherein said thread bolts are composed of structural steel and said thread bushings are composed of corrosion resistant steel.

3. An outer wall as defined in claim 1, wherein said first-mentioned thread bolts are welded to said cross bars.

4. An outer wall as defined in claim 1, wherein each of said thread bolts has an outer thread, each of said thread bushing and said nuts having an inner thread screwable onto said outer thread of the respective thread bolt.

5. An outer wall as defined in claim 1, wherein each of said thread bushings has an outer circumference provided with an engaging face for a screw tool.

6. An outer wall as defined in claim 1, wherein each of said thread bushings is formed as an elongated thread nut.

7. An outer wall as defined in claim 1, wherein each of said sound damping elements has an outer surface, said suspending means further having a clamping element provided with a plurality of openings so that each of said first-mentioned thread bolts extends through a respective one of said openings, each of said thread bushings supporting on said outer surface with interposition of a respective one of said clamping elements.

8. An outer wall as defined in claim 7, wherein said clamping elements is composed of aluminum alloy.

9. An outer wall as defined in claim 7, wherein said clamping element is formed as a single clamping plate provided with said plurality of openings.

10. An outer wall as defined in claim 7, wherein said clamping element includes a plurality of clamping plates each provided with a respective one of said openings.

11. An outer wall as defined in claim 10, wherein each of said clamping plates has a center of gravity, said opening of each of said clamping plates being arranged outside of said center of gravity of the same clamping plate.

12. An outer wall as defined in claim 11, wherein said clamping plates have a rectangular shape.

13. An outer wall as defined in claim 7, wherein said clamping element has an outer surface facing toward said sound damping elements and is provided at said outer surface with friction increasing means.

14. An outer wall as defined in claim 13, wherein said friction increasing means is formed as ridges on said outer surfaces of said clamping element.

15. An outer wall as defined in claim 7, wherein said suspending means further has a plurality of spring rings composed of non-rusting material and each located between said clamping element and a respective one of said thread bushings.

16. An outer wall as defined in claim 15, wherein said spring rings are composed of corrosion resistant steel.

17. An outer wall as defined in claim 1, wherein each of said first-mentioned thread bolts has an end facing toward a respective one of said further thread bolts, and vice versa, said ends of each of said first mentioned thread bolts and a respective one of said further thread bolts being located inside a respective one of said thread bushings and engaging one another.

18. An outer wall as defined in claim 17, wherein said ends of each of said first-mentioned thread bolts and said further thread bolts engage one another under pressure.

* * * * *